US005253957A

United States Patent [19]

Fujikawa

[11] Patent Number: 5,253,957

[45] Date of Patent: Oct. 19, 1993

[54] METHOD OF STOPPING LEAK IN IN-GROUND CONCRETE STRUCTURE

[75] Inventor: Yutaka Fujikawa, Hiroshima, Japan

[73] Assignee: Asset Enterprise Co., Ltd., Tokyo, Japan

[21] Appl. No.: 832,039

[22] Filed: Feb. 6, 1992

[30] Foreign Application Priority Data

Oct. 7, 1991 [JP] Japan ..... 3-258835

[51] Int. Cl.[5] ..... E02D 37/00; E04G 23/02

[52] U.S. Cl. ..... 405/229; 405/266; 52/169.14; 52/744; 264/36

[58] Field of Search ..... 405/53, 55, 229, 266, 405/269, 132; 52/169.5, 169.14, 743, 744; 264/31, 36

[56] References Cited

U.S. PATENT DOCUMENTS

| | | | |
|---|---|---|---|
| 2,898,760 | 8/1959 | Pebley | 405/269 X |
| 4,211,050 | 7/1980 | Cvacho | 52/169.14 X |
| 4,507,069 | 3/1985 | Murray et al. | 405/269 X |
| 4,744,193 | 5/1988 | Hatsuzaki et al. | 52/744 |
| 4,798,502 | 1/1989 | Trout | 405/269 |
| 5,026,215 | 6/1991 | Clarke | 405/266 |
| 5,063,006 | 11/1991 | Tahara | 52/743 X |
| 5,079,895 | 1/1992 | Sinki | 52/743 |

FOREIGN PATENT DOCUMENTS

| | | | |
|---|---|---|---|
| 2363032 | 7/1975 | Fed. Rep. of Germany | 52/744 |

*Primary Examiner*—Dennis L. Taylor
*Assistant Examiner*—John Ricci
*Attorney, Agent, or Firm*—Nikaido, Marmelstein, Murray & Oram

[57] ABSTRACT

In a method of stopping a leak of ground-water in an in-ground concrete structure, a through-hole is drilled in the in-ground concrete structure at a position adjacent to a leak portion, and after that a filler material containing a fine-grain slag cement as a main body is injected from the through-hole behind the leak portion so that the injected filler material fills up the leak portion under the pressurized seeping action of ground-water or the capillary seeping action of ground-water and then firmly and integrally adheres by hydration to a body of the in-ground concrete structure, thereby sealing the leak portion of the in-ground concrete structure.

11 Claims, 1 Drawing Sheet

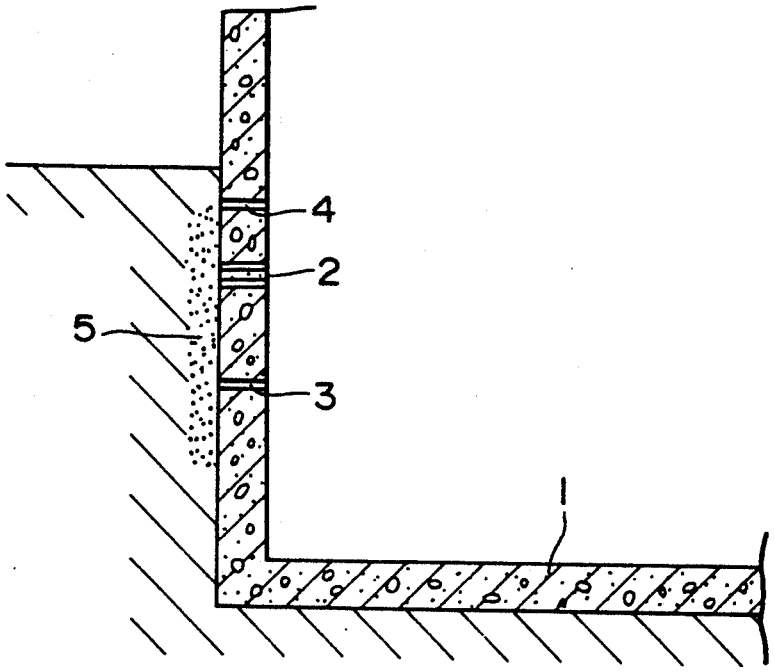
4
2
5
3
1

METHOD OF STOPPING LEAK IN IN-GROUND CONCRETE STRUCTURE

BACKGROUND OF THE INVENTION

1. Field of the Invention

The present invention relates to a method of stopping a leak in an in-ground concrete structure, such as a tunnel, a sewer pipe or an underground structure, which is in contact with the ground.

2. Description of the Prior Art

In-ground concrete structures of the type described may cause a leak of ground-water from a honeycomb portion commonly called as "junk portion" formed due to insufficient packing at the concrete deposition work.

Conventionally, the ground-water leakage is stopped by injecting a filler material such as a cement mortar or a synthetic resin into a space behind the junk portion, or by filling a space behind the junk portion with an expansive material. As an alternative leakage stopping work, a quick-setting cement is coated on a surface of the junk portion.

The conventional leakage stopping means, however, provide only an insufficient adherence between the concrete and the filler material with the result that the leak occurs again due to the pressurized seeping action of ground-water or the capillary seeping action of ground-water.

SUMMARY OF THE INVENTION

With the foregoing drawbacks of the prior art in view, it is an object of this invention to provide a method of stopping a leak in an in-ground concrete structure, which is capable of providing firm adherence between the concrete and a filler material, thereby preventing recurrence of the leak due to pressurized seeping action of the ground-water or the capillary seeping action of the ground-water.

According to this invention, there is provided a method of stopping a leak of ground-water from a leak portion of an in-ground concrete structure, in which a through-hole is formed in the in-ground concrete structure at a position adjacent to the leak portion, and a filler material containing a fine-grain slag cement as its main ingredient is injected from said through-hole behind the leak portion of the in-ground concrete structure so that the injected filler material fills up the leak portion by the action of the pressure of ground-water, thereby sealing the leak portion of the in-ground concrete structure.

It is preferable that the fine-grain slag cement is a mixture of grains having a grain size of 1–9 μm.

Preferably, the through-hole is disposed below the leak portion of the in-ground concrete structure. Before the through-hole is formed, a pressure control hole may be formed in the in-ground concrete structure at a position adjacent to the leak portion on the opposite side thereof from the through-hole. The pressure control hole thus formed insures that the injected filler material fills up the leak portion of the in-ground concrete structure reliably.

The above and other objects, features and advantages of the present invention will become more apparent from the following description when making reference to the detailed description and the accompanying sheets of drawing in which a preferred structural embodiment incorporating the principles of the present invention is shown by way of illustrative example.

BRIEF DESCRIPTION OF THE DRAWING

The FIGURE is a cross-sectional view illustrative of a method of stopping a leak in an in-ground concrete structure according to the present invention.

DETAILED DESCRIPTION OF THE INVENTION

The invention will be described below in greater detail with reference a preferred embodiment illustrated in the accompanying drawing.

A concrete structure 1 installed in the ground (hereinafter referred to as "in-ground concrete structure") has a cracked junk portion 2 from which ground water may leak out to a front surface of the in-ground concrete structure 1. According to the present invention, an inlet through-hole 3 is formed by drilling in the in-ground concrete structure 1 at a position adjacent to the cracked junk portion (leak portion) 2. In the illustrated embodiment, the inlet through-hole 3 is disposed directly below the cracked junk portion 2. A pressure control hole 4 is formed by drilling through the in-ground concrete structure 1 at a position upwardly adjacent to the cracked junk portion 2 on the opposite side of the cracked junk portion 2 from the inlet through-hole 3. The front surface of the cracked junk portion 2 is chipped off by about 3 mm, and after that a filler material 5 containing a fine-grain slag cement as a main component is injected from the inlet through-hole 3 behind the in-ground concrete structure 1. Due to a back pressure or resistance transferred from the ground, the filler material 5 thus injected flows to spread over and along the back surface of the in-ground concrete structure 1. In this instance, due to the action of the pressure control hole 4, most of the injected filler material 5 flows upwardly toward the pressure control hole 4 over and across the back of the cracked junk portion 3. As a consequence of the upward flow of the filler material 5, air and ground-water are forced out in succession from the pressure control hole 4 and, immediately thereafter, the injected filler material 5 overflows from the pressure control hole 4. During that time, the injected filler material 5 existing behind the cracked junk portion 2 flows into the cracked junk portion 2 from behind and then, under the pressurized seeping action of ground-water or the capillary seeping action of the ground-water, the filler material 5 is forced out from the cracked junk portion 2 to the front surface of the in-ground concrete structure 1 while expelling the ground-water from the cracked junk portion 2. It is preferable that the size and position of the pressure control hole 4 are adjusted so as to enable the filler material 5 to fill up the cracked junk portion 2 sufficiently.

When a sufficient overflow of the filler material 5 is confirmed, a sealant is rubbed into the cracked junk portion 2 from the front surface of the in-ground concrete structure 1 so as to stop overflowing of the filler material 5. Then, the front surface of the cracked junk portion 2 is finished by coating with a 2 mm thick mending coat.

Since the filler material 5 penetrating into the cracked junk portion 2 is a fine grain, and preferably a mixture of fine grains having a grain size of 1 to 9 μm, the filler material 5 is distributed over the entire area of the cracked junk portion 2 under the pressurized seeping action of ground-water or the capillary seeping action of the ground-water thereby filling up the cracked junk portion 2. The filler material 5 firmly and integrally adheres by hydration to a body of the in-ground concrete structure 1, thus sealing the cracked junk portion 2. Thus, the leak of ground-water from the cracked junk portion 2 of the in-ground concrete structure 1 is stopped and, hence, the in-ground concrete structure 1 recovers its yielding strength to the previous level.

The foregoing embodiment described above includes a pressure control hole 4 formed in the in-ground concrete structure 1 in opposite relation to the inlet through-hole 3 about the cracked junk portion 2. This is illustrative and not restrictive. According to the invention, the filler material 5 injected from the inlet through-hole 3 is able to fill up the cracked junk portion 2 even when the pressure control hole 4 is omitted.

As described above, according to the invention, a through-hole is formed in an in-ground concrete structure at a portion adjacent to a leak portion from which ground-water leaks. Form the through-hole, a filler material including a fine-grain slag cement as a main body is injected behind the leak portion. The filler material flows into the leak portion under the pressurized seeping action of ground-water or the capillary seeping action of ground water, and then firmly and integrally adheres by hydration to a body of the in-ground concrete structure, thereby sealing the leak portion of the in-ground concrete structure.

Obviously various minor changes and modifications of the present invention are possible in the light of the above teaching. It is therefore to be understood that within the scope of the appended claims the invention may be practiced otherwise than as specifically described.

What is claimed is:

1. A method of stopping a leak of ground-water from a leaking portion of an in-ground concrete structure, comprising the steps of:

(a) forming a through-hole in a non-leaking portion of the in-ground concrete structure at a position adjacent to the leaking portion;

(b) injecting a filler material into said through-hole to a position on the ground side of the leaking portion of the in-ground concrete structure; and (c) causing said injected filler material to fill up said leaking portion from the ground side thereof by the pressure of ground-water, thereby sealing the leaking portion of the in-ground concrete structure.

2. A method according to claim 1, including disposing said through-hole below the leaking portion of the in-ground concrete structure.

3. A method according to claim 1, including forming a pressure control hole in the in-ground concrete structure at a position adjacent to the leaking portion but on the opposite side thereof from said through-hole.

4. A method according to claim 3, including disposing said pressure control hole above the leaking portion of the in-ground concrete structure, and disposing said through-hole below the leaking portion of the in-ground concrete structure.

5. The method as claimed in claim 1, wherein said filler material comprises a fine-grain slag cement as its main constituent.

6. A method according to claim 5, wherein said fine-grain slag cement is a mixture of grains having a grain size of 1–9 μm.

7. A method of stopping a leak of a ground-water through a leaking, disrupted portion of an in-ground concrete structure, said method comprising the steps of:

(a) forming a through hole in a non-leaking portion of the in-ground concrete structure at a position adjacent to said leaking, disrupted portion;

(b) injecting a filler material, containing a fine-grain slag cement as its main component, into said through-hole to an area on the ground side of said concrete structure behind the leaking, disrupted portion of the in-ground concrete structure; and (c) filling up the leaking, disrupted portion of the in-ground concrete structure under pressurized seeping action of ground-water or capillary seeping action of ground-water into said disrupted portion whereby firmly and then integrally adhering said cement to the body of the in-ground concrete structure by hydration, thereby sealing the leaking portion of the in-ground concrete structure.

8. A method according to claim 7, wherein said fine-grain slag cement is a mixture of grains having a grain size of 1–9 μm.

9. A method according to claim 7, including disposing said through-hole below the leaking portion of the in-ground concrete structure.

10. A method according to claim 7, wherein before said filler material is injected, a pressure control hole is formed in the in-ground concrete structure at a position adjacent to the leak portion in opposite relation to said through-hole about the leak portion.

11. A method according to claim 10, wherein said pressure control hole is disposed above the leak portion of the in-ground concrete structure, and said through-hole is disposed below the leak portion of the in-ground concrete structure.

* * * * *